US008944584B2

(12) United States Patent
Sakamoto et al.

(10) Patent No.: US 8,944,584 B2
(45) Date of Patent: Feb. 3, 2015

(54) INK JET RECORDING APPARATUS HAVING CHARGED CONVEYING BELT

(75) Inventors: Atsushi Sakamoto, Kawasaki (JP); Hitoshi Nishikori, Inagi (JP); Nozomu Nishiberi, Yokohama (JP); Yasuyuki Hirai, Yokohama (JP); Yasufumi Tanaami, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 208 days.

(21) Appl. No.: 12/960,772

(22) Filed: Dec. 6, 2010

(65) Prior Publication Data

US 2011/0141213 A1 Jun. 16, 2011

(30) Foreign Application Priority Data

Dec. 16, 2009 (JP) ..... 2009-285194

(51) Int. Cl.
*B41J 2/01* (2006.01)
*B41J 11/00* (2006.01)

(52) U.S. Cl.
CPC ..... *B41J 11/0085* (2013.01); *B41J 11/0015* (2013.01); *B41J 11/007* (2013.01)
USPC ..... 347/104

(58) Field of Classification Search
None
See application file for complete search history.

(56) References Cited

U.S. PATENT DOCUMENTS 6,026,270 A * 2/2000 Okiyama et al. ..... 399/303
6,786,590 B2 9/2004 Maki et al.
7,591,458 B2 9/2009 Maki
2001/0028381 A1* 10/2001 Kashiwagi et al. ..... 347/104
2006/0033968 A1* 2/2006 Maki ..... 358/498
2006/0279621 A1 12/2006 Morohoshi
2007/0109385 A1* 5/2007 Imoto et al. ..... 347/104
2008/0241398 A1* 10/2008 Kato et al. ..... 427/288
2010/0079515 A1* 4/2010 Kuwahara et al. ..... 347/7
2010/0189481 A1 7/2010 Yamamuro et al.
2011/0057988 A1* 3/2011 Izumikawa et al. ..... 347/21
2011/0164086 A1* 7/2011 Ggoto et al. ..... 347/21

FOREIGN PATENT DOCUMENTS

EP 0 887 196 A2 12/1998
EP 2 116 382 A1 11/2009

(Continued)

OTHER PUBLICATIONS

Communication and European Search Report dated Mar. 14, 2011, issued in counterpart European Patent Application No. 10015479.8.

(Continued)

*Primary Examiner* — Geoffrey Mruk
*Assistant Examiner* — Bradley Thies
(74) *Attorney, Agent, or Firm* — Fitzpatrick, Cella, Harper & Scinto

(57) ABSTRACT

An ink jet recording apparatus capable of landing an ink drop on an exact position on a recording medium is provided. The ink jet recording apparatus performs recording on a recording medium which has been subjected to application processing with a pretreatment liquid. The ink jet recording apparatus has an electrostatic belt which has a resistance layer formed on the surface thereof, and a power feed roller which imparts charges to the surface of the electrostatic belt. The recording head discharges ink to the surface of the recording medium when the back of the recording medium comes into contact with the surface of the electrostatic belt to which the charges have been imparted.

22 Claims, 4 Drawing Sheets

(56) References Cited

FOREIGN PATENT DOCUMENTS

| | | | | |
|---|---|---|---|---|
| JP | 11-322110 | A | 11/1999 | |
| JP | 2001-353861 | A | 12/2001 | |
| JP | 2001353861 | A * | 12/2001 | ..... B41J 2/01 |
| JP | 2004-262557 | A | 9/2004 | |
| JP | 2005-15227 | A | 1/2005 | |
| JP | 2006-219235 | A | 8/2006 | |
| JP | 3804928 | B2 | 8/2006 | |
| JP | 2007-106511 | A | 4/2007 | |
| JP | 2008-94605 | A | 4/2008 | |
| WO | 2004/067424 | A1 | 8/2004 | |
| WO | 2004/108419 | A1 | 12/2004 | |
| WO | 2005/108253 | A1 | 11/2005 | |

OTHER PUBLICATIONS

Office Action dated Nov. 19, 2013, in Japanese Application No. 2009-285194.

* cited by examiner

INK JET RECORDING APPARATUS HAVING CHARGED CONVEYING BELT

BACKGROUND OF THE INVENTION

1. Field of the Invention

The present invention relates to an ink jet recording apparatus which performs recording on a recording medium.

2. Description of the Related Art

Recently, in order to meet market demands for higher image quality and higher speed of recording in an ink jet recording apparatus, the realization of multiple colors, higher density, smaller drops, a larger number of nozzles, and the like are progressing. As a result, the ink jet recording apparatus is able to provide a user with a photo image which is no way inferior to a silver halide photograph when printing to special media as well as for the purposes of printing of web content or a text on a plain paper. Additionally, an ink jet recording apparatus for business or industry with increased printing speeds like those of a laser beam printer has also been developed.

In the ink jet recording apparatus for business or industry, the nozzles of the recording head are often made long in order to increase the printing speed. However, in such an ink jet recording apparatus, it is difficult to keep constant the distance (hereinafter referred to as the "distance with respect to sheet") from the nozzle face of a recording head to the recording face of the recording medium. This is because the distance from a pinch roller which supports the recording medium on the upstream side from the recording head to a sheet ejection roller which supports the recording medium on the downstream side from the recording head becomes longer. In such an ink jet recording apparatus, floating of a recording medium, a flapping (cockling) phenomenon which is caused as ink permeates into a recording medium, or the like easily occurs, it is difficult to keep the distance with respect to sheet constant between the pinch roller and the sheet ejection roller.

In the ink jet recording apparatus, in order to keep the distance with respect to sheet constant, an electrostatic adsorption conveyance system, a perforated platen conveyance system, or the like is used. The electrostatic adsorption conveyance system adopts an endless conveying belt in a recording medium conveying mechanism, and makes static electricity generated on the surface of the conveying belt adsorb and convey the recording medium. The perforated platen conveyance system makes the back of a recording medium be air-adsorbed on the conveying belt immediately below a recording area.

In Japanese Patent Application Laid-Open No. 2001-353861, an ink jet recording apparatus including an electrostatic adsorption conveyance system is disclosed. The electrostatic adsorption conveyance system of this ink jet recording apparatus performs DC (Direct Current) charging on a conveying belt with a high-resistance single layer structure, and adsorbs and conveys a recording medium.

Also in Japanese Patent No. 3804928 and Japanese Patent Application Laid-Open No. 2004-262557, an ink jet recording apparatus including an electrostatic adsorption conveyance system is disclosed. The electrostatic adsorption conveyance system of these ink jet recording apparatuses performs AC (Alternating Current) charging on a conveying belt with a two-layer structure in which the surface layer is an insulating layer and the back layer is a conductive layer, and adsorbs and conveys a recording medium.

In the electrostatic adsorption conveyance system, which performs DC charging on the conveying belt of a single layer structure, disclosed in Japanese Patent Application Laid-Open No. 2001-353861, it is known that an abrupt decrease in the adsorption force of the conveying belt to a recording medium may occur when the recording medium is adsorbed and conveyed. Thereby, deterioration of image quality due to floating of the recording medium or rubbing of the surface of the recording medium caused by the interference between the recording medium and the recording head may occur.

Additionally, it is known that, if the charging method is changed to the AC charging from the DC charging in the configuration of the electrostatic adsorption conveyance system disclosed in Japanese Patent Application Laid-Open No. 2001-353861, the abrupt decrease of the adsorption force of the conveying belt to the recording medium becomes rather conspicuous.

In the electrostatic adsorption conveyance system, which performs the AC charging on the conveying belt of a two-layer structure, disclosed in Japanese Patent No. 3804928 and Japanese Patent Application Laid-Open No. 2004-262557, a recording streak may be confirmed at the timing (pitch of half of a positive or negative charging cycle) with which positive and negative charges applied to the conveying belt are switched.

Although the average charging distribution of the conveying belt immediately below the recording head is uniform since the surface potential becomes "0", a positively charged portion and a negatively charged portion are microscopically generated in the conveying direction of a recording media on the conveying belt. On the boundary portion between the positively charged portion and the negatively charged portion, an ink drop discharged onto a recording medium is pulled toward the positively charged portion or the negatively charged portion by Coulomb forces. Therefore, since the ink drop does not land exactly on the recording medium at the boundary portion between the positively charged portion and the negatively charged portion on the conveying belt, it is believed that this appears as a recording streak. This phenomenon is particularly conspicuous in a case where the velocity of an ink drop is slow.

Moreover, in a case where the AC charges are imparted to the conveying belt, it is known that there is also a problem in that the adsorption force of the conveying belt to the recording medium decreases abruptly when ink mist or dust adheres to the conveying belt. In a case where positively charged portions and negatively charged portions are repeatedly formed in the conveying direction on the conveying belt which has been subjected to the AC charging, and the surface resistance of the conveying belt is high, movement of charges does not occur between the positively charged portion and the negatively charged portion. However, since the surface resistance of the conveying belt decreases in a case where ink mist, dust, or the like adheres to the conveying belt, movement of charges occurs between the positively charged portion and the negatively charged portion of the conveying belt. Thereby, since the surface charges of the conveying belt will be cancelled, it is believed that the adsorption force of the conveying belt to the recording medium will decrease.

SUMMARY OF THE INVENTION

The invention has been made in consideration of the above problems, and the object of the invention is to provide an ink jet recording apparatus capable of landing an ink drop on an exact position on a recording medium.

In order to achieve the above object, the ink jet recording apparatus of the invention is an ink jet recording apparatus which records on a recording medium which has been subjected to application processing with a pretreatment liquid.

The apparatus includes: a conveying belt having a resistance layer formed on a first face thereof; a charge imparting portion which imparts first charges to the first face of the conveying belt; and a recording head which discharges ink to the first face of the recording medium when a second face opposite to the first face of the recording medium comes into contact with the first face of the conveying belt to which the first charges have been imparted.

According to the invention, it is possible to provide an ink jet recording apparatus capable of bringing a recording medium into close contact with the conveying belt and making an ink drop land on an exact position on the recording medium.

Further features of the present invention will become apparent from the following description of exemplary embodiments with reference to the attached drawings.

DESCRIPTION OF THE EMBODIMENTS

A preferred embodiment of the present invention will now be described in detail in accordance with the accompanying drawings.

Figure 1:
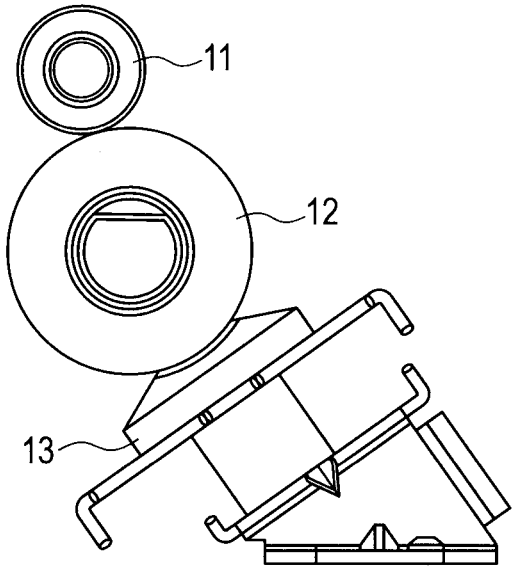
FIG. 1 is a schematic diagram of an application portion which applies a pretreatment liquid to a recording medium related to one embodiment of the invention.

FIG. 1 is a schematic diagram of an application portion which performs the application processing of applying a transparent pretreatment liquid to a recording medium before the recording of an ink jet recording apparatus related to one embodiment of the invention.

A pretreatment liquid is held in a cap 13. When an auxiliary roller 11 rotates, an application roller 12 which comes into contact with the cap 13 rotates so as to follow the auxiliary roller 11. As a result, the pretreatment liquid supplied from the cap 13 adheres to the surface of the application roller 12 in a thinly drawn-out form. Therefore, when a recording medium is nipped and passes between the auxiliary roller 11 and the application roller 12, a transparent pretreatment liquid adheres to the surface of the recording medium which comes into contact with the application roller 12.

This transparent pretreatment liquid is a liquid applied mainly in cases where a plain paper is used as a recording medium, and is a liquid used for the purpose of improvements in the deterioration (feathering) of the quality of the edges of a character or an image or in the oozing phenomenon (bleeding) of ink at boundary portions between a plurality of kinds of color ink. This pretreatment liquid generally includes a cohesion/fixation promoter which reacts, other than with water, with the ink discharged from a recording head, and promotes the cohesion or fixation of a color material, and is able to shorten the time taken until an ink drop is fixed on the surface of a recording medium after the ink drop has landed on the recording medium. As the cohesion/fixation promoter, univalent or bivalent metal salt or the like is typical. Additionally, in many cases, a nonvolatile solvent, a surfactant, a preservative, and the like other than the cohesion/fixation promoter are included in the pretreatment liquid. As just described, the quality of a character or image formed on a recording medium becomes high due to the application of the transparent pretreatment liquid.

Figure 2:
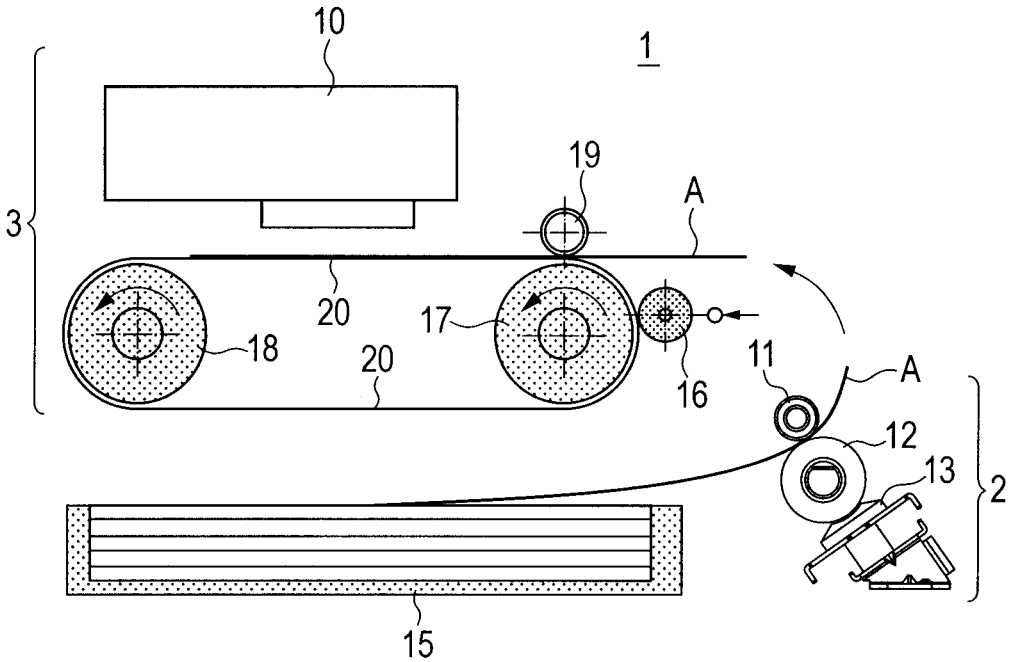
FIG. 2 is a schematic diagram of an ink jet recording apparatus related to one embodiment of the invention.

FIG. 2 is a schematic diagram of the configuration of the ink jet recording apparatus 1 related to the present embodiment. Portions other than the portions involved in the features of the present embodiment are omitted in FIG. 2. The ink jet recording apparatus 1 has a sheet feed portion 2 which supplies a recording medium A, and a recording portion 3 which conveys the recording medium A supplied from the sheet feed portion 2 using an electrostatic belt 20 and performs recording on the recording medium A. In addition, in the present embodiment, a first face which is one face of the recording medium A or electrostatic belt 20 is referred to the surface, and a second face which is the other face opposite to the first face of the recording medium A or electrostatic belt 20 is referred to as the back.

In the sheet feed portion 2, in order to separate the recording medium A stacked on a recording medium cassette 15 one by one with a pickup mechanism (not illustrated) and to apply a transparent pretreatment liquid to the surface of the recording medium, the recording medium is made to pass between the auxiliary roller 11 and the application roller 12.

Thereafter, the recording medium A to the surface of which the pretreatment liquid has been applied passes through a recording medium conveyance system (not illustrated), and is conveyed to the electrostatic belt 20 which is a conveying belt for conveying the recording medium A of the recording portion 3. Then, the recording medium A is stacked on the electrostatic belt 20 so that the back of the recording medium A to which the pretreatment liquid is not applied comes into contact with the surface of the electrostatic belt 20. At this time, the surface of the recording medium A faces upwards where the recording head 10 is present.

The electrostatic belt 20 is endless, and is formed to have an overall loop-shape. The electrostatic belt 20 may be integrally molded in the shape of a loop, or may be formed in the shape of a loop after being molded in the shape of a belt by connecting both ends thereof. The electrostatic belt 20 is held by a driving roller 17 and a driven roller 18 and is repeatedly rotated by the driving force of the driving roller 17.

The electrostatic belt 20 has a two-layer structure of a surface layer and a back layer. The surface layer of the electrostatic belt 20 which adsorbs the back of the recording medium A is a resistance layer of which the volume resistance ratio is equal to or greater than $1.0\times10^{12}$ (Ω·cm). Additionally, the back layer of the electrostatic belt 20 which comes into contact with the driving roller 17 and the driven roller 18 is an middle-resistance layer of which the volume resistance ratio is equal to or greater than $1.0\times10^{4}$ (Ω·cm) and equal to or less than $1.0\times10^{9}$ (Ω·cm). As a base material which forms the electrostatic belt 20, for example, PI (Polyimide), fluorine-based resin, and the like are used. For the adjustment of the volume resistance ratio of the electrostatic belt 20, an additive in which adjustment of ingredients or quantity has been made is added to the above-described base material. Carbon, a surfactant, and the like are used for the additive.

The driving roller 17 is a first grounding portion which is grounded, and comes into contact with the back layer (middle-resistance layer) of the electrostatic belt 20, thereby grounding the back layer of the electrostatic belt 20. In this state, a power feed roller 16 which is a charge imparting portion imparts charges to the surface of the electrostatic belt 20. Thereafter, when the back of the recording medium A comes into contact with the surface of the electrostatic belt 20 to which the charges have been imparted, the back of the recording medium A is electrostatically adsorbed on the surface of the electrostatic belt 20. This makes the recording medium A not easily separate from the electrostatic belt 2.

Thereafter, the recording medium A is nipped and passes between a pinch roller 19 which is a second grounding portion which is grounded, and the electrostatic belt 20. The pinch roller 19 plays a mechanical role of pushing the recording medium A against the electrostatic belt 20, and plays an electrical role of imparting second charges, with a sign which is reverse to that of first charges imparted to the surface layer of the electrostatic belt 20 by the power feed roller 16, to the surface of the recording medium A. That is, if the first charges are positive charges, the second charges are negative charges, and if the first charges are negative charges, the second charges are positive charges. By imparting charges with signs which are reverse to each other to the surface of the electrostatic belt 20, and the surface of the recording medium A, the electrostatic adsorption force of the surface of the electrostatic belt 20 onto the back of the recording medium A becomes powerful. This makes the recording medium A less easily separated from the electrostatic belt 2.

After the recording medium A has come into contact with the pinch roller 19, ink is discharged from the recording head 10 to the surface of the recording medium A to which the pretreatment liquid has been applied. The recording medium A is ejected by a sheet ejection tray (not illustrated) of the ink jet recording apparatus 1 after the recording by the recording head 10 is completed.

(Regarding Resistance Ratio in Thickness Direction and Surface Resistance Ratio of Recording Medium)

Application processing with a pretreatment liquid to the surfaces of recording media was performed under different conditions, always using the same plain papers as the recording media. Thereby the following three kinds of recording media A to Z were prepared. The recording medium X was a plain paper to which a pretreatment liquid was not applied. The recording medium Y was one obtained by applying a pretreatment liquid, to which 0.3 wt % of surfactant has was added, to the surface of a plain paper. The recording medium Z was one obtained by applying a pretreatment liquid, in which the additive amount of the surfactant of the pretreatment liquid applied to the recording medium Y was increased to 5.0 wt %, to the surface of a plain paper. In addition, the application amount and application conditions of the pretreatment liquids to the surface of the recording medium Y and the recording medium Z were the same. As for the recording media X to Z, measurement of a resistance ratio Rt in the thickness direction and a surface resistance ratio Rs was performed.

In addition, the resistance ratio Rt in the thickness direction of a recording medium is a value obtained by dividing the resistance per unit area in the thickness direction of the recording medium by the thickness of the recording medium. That is, the resistance ratio Rt represents the average value of the total resistance ratio in the thickness direction of a recording medium.

Additionally, the unit of the surface resistance ratio Rs is typically denoted by (Ω). However, in order to be distinguished from the resistance R between two points which are merely different from each other, the surface resistance ratio units shall be expressed by (Ω/□) as meaning of resistance per square unit. Additionally, the unit of the surface resistance ratio may be expressed by (Ω/Sq.) or the like.

Measurement results of Rt and Rs of recording media X to Z are shown below.

Recording Medium X

Rt: $3.5\times10^{14}$ (Ω·cm)

Rs: $3.5\times10^{16}$ (Ω/□)

Recording Medium Y

Rt: $2.0\times10^{14}$ (Ω·cm)

Rs: $2.1\times10^{10}$ (Ω/□)

Recording Medium Z

Rt: $1.0\times10^{9}$ (Ω·cm)

Rs: $8.6\times10^{9}$ (Ω/□)

In the recording medium X without the application of a pretreatment liquid, both Rt and Rs are very large, and the recording medium was in an almost insulated state. In the recording medium Y to which a pretreatment liquid to which 0.3 wt % of surfactant was added was applied, Rt was not greatly different from that of the recording medium X, but Rs was lower than the recording medium X by 6 digits. In the recording medium Z to which a pretreatment liquid of 5.0 wt % of surfactant was applied, Rs was not only lower than the recording medium X by 6 digits but also Rt was lower than the recording medium X by 5 digits.

Figure 3A:
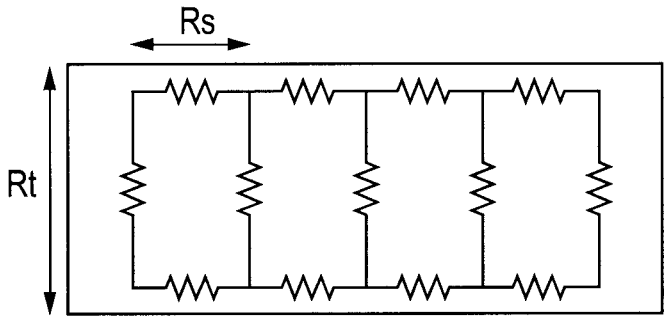
FIGS. 3A, 3B and 3C are model diagrams of the relationship between the permeation conditions of a pretreatment liquid and electrical resistance with respect to a recording medium.
Figure 3B:
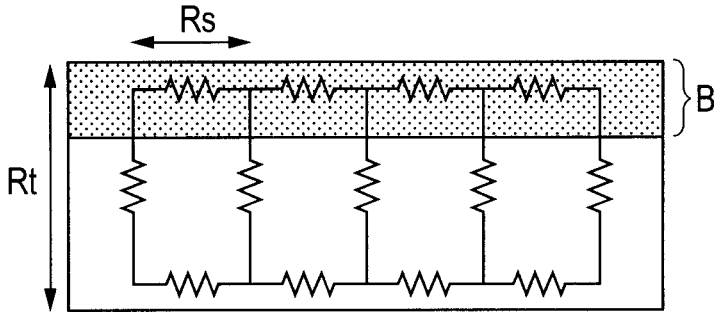
Figure 3C:
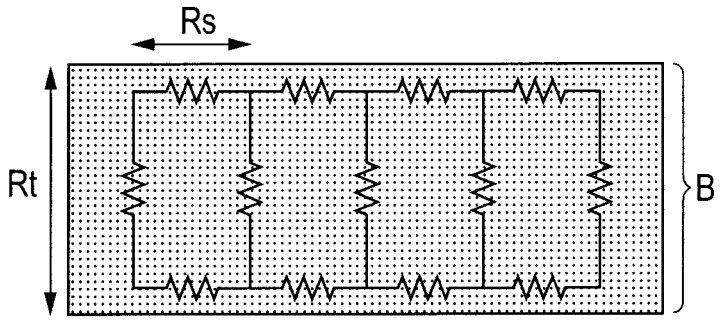

Model diagrams of the relationship between the permeation conditions of a pretreatment liquid and Rt and Rs in the recording media X to Z are illustrated in FIGS. 3A to 3C. FIGS. 3A to 3C correspond to the recording media X to Z, respectively. FIGS. 3A to 3C show sections in the thickness direction of respective recording media, with the surface of each recording medium turned upward and the back thereof turned downward.

In the recording medium X to which a pretreatment liquid was not applied, as illustrated in FIG. 3A, a pretreatment liquid permeation layer B was not formed. On the other hand, as illustrated in FIGS. 3B and 3C, a pretreatment liquid permeation layer B was formed on the recording medium Y and recording medium Z to which a pretreatment layer was applied. Additionally, in the recording medium Z of which the concentration of a surfactant of a pretreatment liquid was high, the pretreatment liquid permeation layer B was formed in the whole thickness direction. In contrast, in the recording medium Y of which the concentration of a surfactant of a pretreatment liquid was low, the pretreatment liquid permeation layer B was formed only partway through in the thickness direction.

From the above results, it is considered that the pretreatment liquids have the action of lowering the electrical resistance of the recording media, and Rt and Rs of the recording media greatly change depending on the formation of the pretreatment liquid permeation layer. That is, it is considered that both Rt and Rs are high in the recording medium X in which the pretreatment liquid permeation layer B is not formed, and both Rt and Rs are low in the recording medium C in which the pretreatment liquid permeation layer B is formed in the whole thickness direction. Additionally, it is considered that, in the recording medium Y in which the pretreatment liquid permeation layer B is formed only on the surface side, the surface resistance ratio Rs is low, but the resistance ratio Rt in the thickness direction is high.

With respect to these three kinds of recording media X to Z, the adsorption force to the electrostatic belt 20 was measured using the recording portion 3 illustrated in FIG. 2. In this measurement, DC-2.0 kV of negative charges were imparted to each recording medium as the power feed conditions of the power feed roller 16. That is, negative charges were imparted to the surface of the electrostatic belt 20 by the power feed roller 16, and positive charges were applied to the surface of the recording medium by the pinch roller 19. The measurement was performed on 100 continuous sheets for each recording medium.

Figure 4:
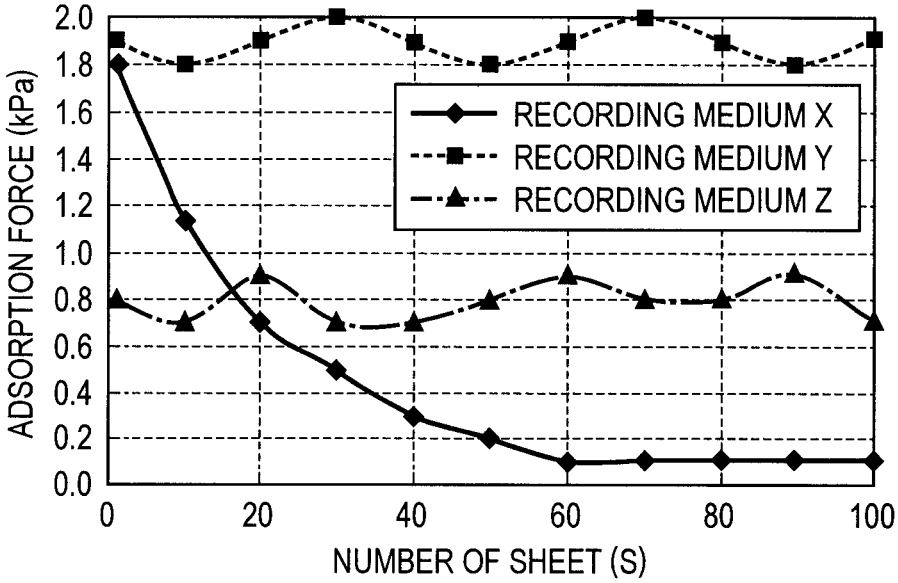
FIG. 4 is a graph illustrating the relationship between the number of sheets and adsorption force of a recording medium related to one embodiment of the invention.

FIG. 4 illustrates a graph illustrating the results. FIG. 4 illustrates changes in the adsorption force of every tenth recording media. The data of the recording medium X is indicated by a ♦ mark, the data of the recording medium Y is indicated by a ■ mark, and the data of the recording medium Z is indicated by a ▲ mark. The vertical axis of FIG. 4 represents adsorption force (kPa) converted from horizontal tensile force required for separating a recording medium from the electrostatic belt 20, and the horizontal axis thereof represents the number of sheets which were continuously passed.

In the recording medium X, it was found that the adsorption force was high up to several sheets, but the adsorption force reduced gradually as sheets continued passing, and the adsorption force was hardly generated in the 60th to 100th sheets. In the recording medium Y, it was found that a high adsorption force around 1.9 kPa was maintained from the first sheet to the 100th sheet within the range of a certain degree of variation. In the recording medium Z, it was found that a slightly low adsorption force of about 0.8 kPa was maintained from the first sheet to the 100th sheet.

From these experiment results, it was found that the resistance ratio in the thickness direction and surface resistance ratio of a recording medium have a great influence on the adsorption force to the electrostatic belt 20 in the conveyance system using the electrostatic belt 20 shown in FIG. 2.

Figure 5:
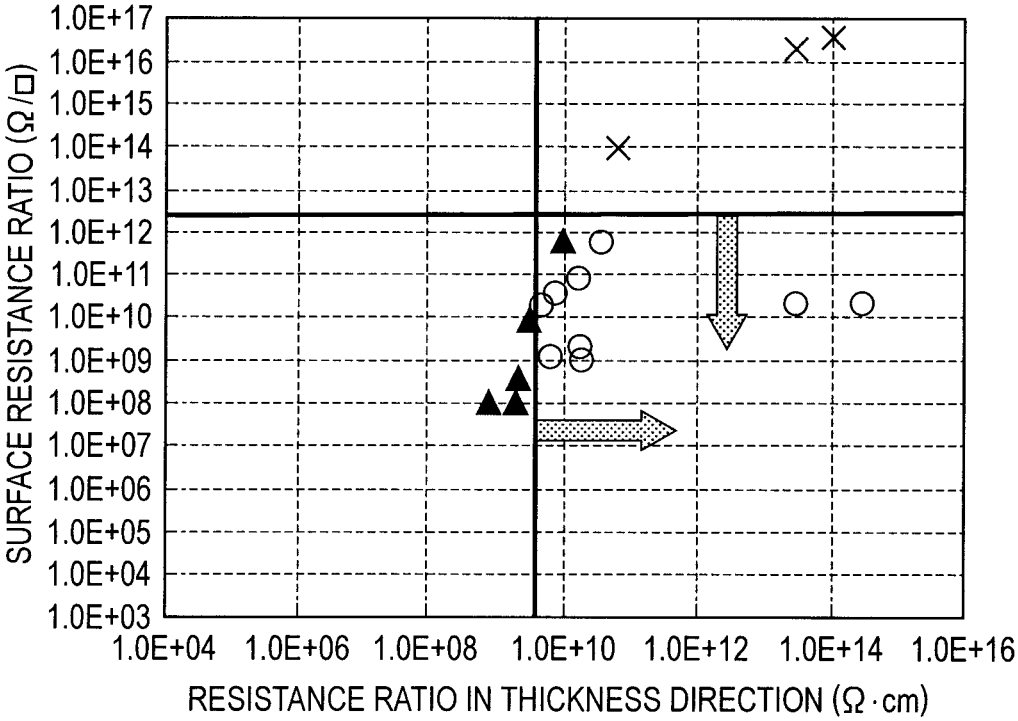
FIG. 5 is a graph illustrating the quality of adsorption force caused by the resistance ratio in the thickness direction and surface resistance ratio of a recording medium.

Moreover, in order to investigate the influence of the resistance ratio in the thickness direction and surface resistance ratio of recording media, on the adsorption force to the electrostatic belt 20, the adsorption force to the electrostatic belt 20 was measured after recording media with various resistance ratios in the thickness directions and various surface resistance ratios was prepared. The adjustment of the resistance ratio in the thickness direction and surface resistance ratio of the recording media was performed by changing the concentration of surfactant in a pretreatment liquid applied to each recording medium. In addition, all of the recording media before application of a pretreatment liquid were the same plain papers, and the application amount and application conditions of the pretreatment liquid to each recording medium were fixed. The results are illustrated in FIG. 5. In FIG. 5, the vertical axis represents the surface resistance ratio of the recording media, and the horizontal axis is the resistance ratio in the thickness direction of the recording media. Additionally, the errors of the electrical resistance of the recording media caused by the influence of humidity are also included in the results illustrated in FIG. 5.

Marks ○, ▲, and X in the graph of FIG. 5 indicate the level of the adsorption force of the recording media to the electrostatic belt 20, respectively. Mark ○ indicates that the adsorption force is equal to or greater than 1.0 kPa, Mark ▲ indicates that the adsorption force is equal to or greater than 0.5 kPa and less than 1.0 kPa, and Mark X indicates that the adsorption force is less than 0.5 kPa.

It is understood from FIG. 5 that the factor which has the most influence on the adsorption force of the recording media to the electrostatic belt 20 is the surface resistance ratio of the recording media. It was found that, if the surface resistance ratio is equal to or less than about $5.0\times10^{12}$ (Ω/□), a high adsorption force is obtained. Additionally, the resistance ratio in the thickness direction has also an influence on the adsorption force of the recording medium to the electrostatic belt 20. It was found that, if the resistance ratio in the thickness direction is equal to or greater than $5.0\times10^{9}$ (Ω·cm), a high adsorption force is obtained.

That is, it was found that it is possible to perform stable conveyance of the recording media by adjusting the pretreatment liquid in a case where the pretreatment liquid is applied to the recording media in a conveyance system which has adopted a DC charging method using an electrostatic belt 20 with a two-layer structure illustrated in FIG. 2. Specifically, it was found that the pretreatment liquid may be adjusted so that the surface resistance ratio of a recording medium becomes equal to or less than $5.0\times10^{12}$ (Ω/□) and the resistance ratio in the thickness direction of the recording medium becomes equal to or greater than $5.0\times10^{9}$ (Ω·cm).

Figure 6:
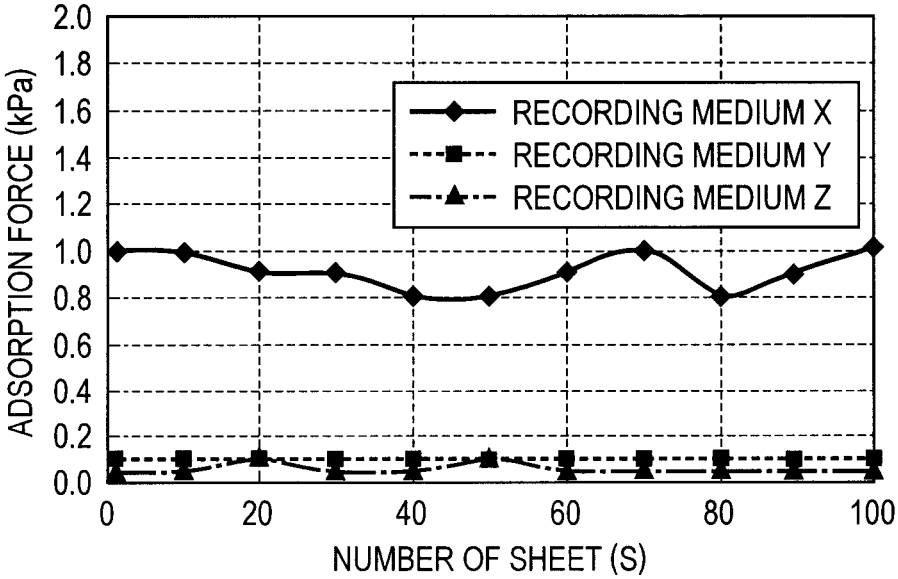
FIG. 6 is a graph illustrating the relationship between the number of sheets and adsorption force of a recording medium related to a comparative example.

Next, as comparative examples, only the electrostatic belt 20 of the recording portion 3 illustrated in FIG. 2 in the above-described recording media X to Z was changed to an electrostatic belt with a single layer structure of which the volume resistance ratio is $1.0\times10^{16}$ (Ω·cm), and the adsorption force to this electrostatic belt was measured. In this measurement, DC-2.0 kV of negative charges were applied to each recording medium as the power feed conditions of the power feed roller 16, and the measurement was performed for 100 continuous sheets for each recording medium. The data of the recording medium X is indicated by a ♦ mark, the data of the recording medium Y is indicated by a ■ mark, and the data of the recording medium Z is indicated by a ▲ mark. The vertical axis of FIG. 6 represents adsorption force (kPa) converted from horizontal tensile force required for separating a recording medium from the electrostatic belt, and the horizontal axis thereof represents the number of sheets which were continuously passed.

In the recording medium X to which a pretreatment liquid is not applied, it was found that an adsorption force of about 1.0 kPa was maintained from the first sheet to the 100th sheet. In any of the recording medium Y and recording medium Z to which a pretreatment liquid is applied, it was found that the adsorption force was extremely low from the first sheet to the 100th sheet.

From these experiment results, it was found that a sufficient adsorption force of the electrostatic belt to a recording medium was not obtained depending on the application of a pretreatment liquid to the recording medium in the electrostatic belt conveyance system which has adopted a DC charging method using an electrostatic belt with a single layer structure. Additionally, even in an electrostatic belt conveyance system in which only the charging method is changed to an AC charging method using the same electrostatic belt with a single layer structure, the results were almost the same as the results illustrated in FIG. 6. From these results, it is considered that a sufficient adsorption force of the electrostatic belt with respect to a recording medium was not obtained in a case where the resistance ratio in the thickness direction and the surface resistance ratio of the recording medium are low when the electrostatic belt with a single layer structure was used.

For example, water, cohesion/fixation promoter, a non-volatile solvent, a surfactant, a preservative, and the like are included in a transparent pretreatment liquid applied to a recording medium. Even when the formulation of these ingredients of the pretreatment liquid is adjusted, any decrease in the resistance ratio in the thickness direction or surface resistance ratio of a recording medium to which a pretreatment liquid has been applied cannot be avoided. Therefore, it is extremely difficult to realize the combination of a system which applies a pretreatment liquid to a recording medium and an electrostatic belt conveyance system using electrostatic adsorption of a recording medium in an electrostatic belt of a single layer structure.

Next, recording was performed using the recording portion 3 illustrated in FIG. 2 on the recording medium Y to which the pretreatment liquid, in which the additive amount of the surfactant illustrating good results in FIG. 4 is 0.3 wt %, has been applied, and a recording streak generated in the recording medium was evaluated. As the conditions of power feed to the electrostatic belt 20 by the power feed roller 16, two conditions of DC-2.0 kV charging and AC±2.0 kV charging were adopted. Additionally, as the conditions of the distance from the discharge port face of the recording head 10 to the surface of the electrostatic belt 20, two conditions of 1.0 mm and 2.0 mm were adopted. In the respective conditions, the recording streak of an image recorded on the surface of the recording medium was evaluated.

In the case of the AC charging condition, a recording streak was confirmed at the portion of the recording medium on the boundary between a positively charged portion of the electrostatic roller 20 to which positive charges have been imparted and a negatively charged portion of the recording medium to which negative charges have been imparted. Additionally, the degree of the recording streak was worse in the case of the condition where the distance from the discharge port face of the recording head 10 to the surface of the electrostatic belt 20 was 2.0 mm than in the case of the condition that the distance was 1.0 mm. It is considered that this is because, due to air resistance, the velocity of ink decreases until landing on the surface of the recording medium after discharge of an ink drop as the distance from the discharge port face of the recording head 10 to the surface of the electrostatic belt 20 increases. If the velocity of the ink decreases, since the influence of the Coulomb forces which act on each other due to the charges of the surface of the recording medium and the charges that the ink drop carries increases, the landing position of the ink drop to the surface of the recording medium will deviate.

On the other hand, in the case of the DC charging condition, a recording streak was scarcely observed on the recording medium. In the case of the condition where the distance from the discharge port face of the recording head 10 to the surface of the electrostatic belt 20 was 1.0 mm, the level of image quality was high, and even in the case of the condition that the distance was 2.0 mm, the resulting image quality level was allowable. As just described, it was found that the image quality of a recording medium became better under DC charging condition where one of positive charges and negative charges were imparted to the electrostatic belt 20 than under the AC charging condition where the positively charged portion to which positive charges have been imparted and the negatively charged portion to which negative charges have been imparted were generated in the electrostatic belt 20.

As described above, in the electrostatic belt conveyance system using the electrostatic belt 20 with a two-layer structure illustrated in FIG. 2, a sufficient adsorption force of the electrostatic belt 20 with respect to the recording medium A was secured by the adoption of the DC charging method and by the adjustment of the surface resistance ratio and resistance ratio in the thickness direction of the recording medium A. Specifically, it is desirable that adjustment is made so that the surface resistance ratio of the recording medium A becomes equal to or less than $5.0\times10^{12}$ (Ω/□) and the resistance ratio in the thickness direction of the recording medium A becomes equal to or greater than $5.0\times10^{9}$ (Ω·cm).

In addition, in the electrostatic belt conveyance system which has adopted the DC charging method using the electrostatic belt 20 with a two-layer structure illustrated in FIG. 2, even in case where a pretreatment liquid was applied to the back of the recording medium A instead of the surface of the recording medium A, the same results as those of FIGS. 4 and 5 were obtained. That is, it was found that, even when a pretreatment liquid is applied to the back of the recording medium A and the back of the recording medium A is adsorbed by the electrostatic belt 20, a sufficient adsorption force of the electrostatic belt 20 with respect to the recording medium A is secured. Even in this case, it is desirable that adjustment is made so that the resistance ratio of the back of the recording medium A becomes equal to or less than $5.0\times10^{12}$ (Ω/□) and the resistance ratio in the thickness direction of the recording medium A becomes equal to or greater than $5.0\times10^{9}$ (Ω·cm).

Additionally, in the electrostatic belt conveyance system which has adopted the DC charging method using the electrostatic belt 20 with a two-layer structure illustrated in FIG. 2, even in a case where a pretreatment liquid was applied to both the surface and back of the recording medium A, the same results as those of FIGS. 4 and 5 were obtained. That is, it was found that, even when a pretreatment liquid is applied to the surface and back of the recording medium A and one of the surface and the back of the recording medium A is adsorbed by the electrostatic belt 20, a sufficient adsorption force of the electrostatic belt 20 with respect to the recording medium A is secured. In this case, it is desirable that adjustment is made so that the average value of the resistance ratio of the surface of the recording medium A and the resistance ratio of the back of the recording medium becomes equal to or less than $5.0\times10^{13}$ (Ω/□) and the resistance ratio in the thickness direction of the recording medium A becomes equal to or greater than $1.0\times10^{9}$ (Ω·cm).

Moreover, in a case where a pretreatment liquid was applied to both the surface and back of the recording medium A, it is possible to keep the quality of recording of both faces of the recording medium A high even in a case where double-sided printing is performed. That is, even in a case where recording is performed not only on the surface of the recording medium A but on the back of the recording medium A in the recording portion 3 of the recording apparatus 1 illustrated in FIG. 2, it is possible to prevent feathering or bleeding on both faces of the recording medium A.

Additionally, in the present embodiment, the concentration of a surfactant in a pretreatment liquid applied to a recording medium was changed for the adjustment of the surface resistance ratio and resistance ratio in the thickness direction of the recording medium. However, other methods may be used for the adjustment of the surface resistance ratio and resistance ratio in the thickness direction of the recording medium. For example, it is possible to adjust the surface resistance ratio and resistance ratio in the thickness direction of a recording medium by changing the viscosity of a pretreatment liquid applied to a recording medium or by changing the application amount of a pretreatment liquid to a recording medium.

Additionally, the ink jet recording apparatus 1 illustrated in FIG. 2, the sheet feed portion 2 may not have the application portion. For example, in the ink jet recording apparatus 1, the application portion may be provided in the recording head 10. In this case, the recording head 10 discharges a pretreatment liquid to the recording medium A before ink is discharged. Thereafter, ink is discharged to the recording medium A to which the pretreatment liquid has been applied.

Additionally, although the ink jet recording apparatus 1 illustrated in FIG. 2 includes the application portion as a part, the application portion illustrated in FIG. 1 may be provided independently from the ink jet recording apparatus 1. That is, a configuration may be adopted in which the recording medium A to which a pretreatment liquid has been applied by this independently provided application portion is stacked on the recording medium cassette 15. In this case, the recording medium A which is stacked on the recording medium cassette 15 and has the pretreatment liquid applied thereto is conveyed directly to the electrostatic belt 20, and recording is performed on the recording medium by the recording head 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-285194, filed Dec. 16, 2009, which is hereby incorporated by reference herein in its entirety.

What is claimed is:

1. An ink jet recording apparatus which records on a recording medium having a first face and a second face, the apparatus comprising:

a conveying belt which conveys the recording medium while a surface of the conveying belt contacts the second face;

a first DC charge unit which imparts one of positive charges and negative charges to the surface of the conveying belt;

a recording head which discharges ink to the first face of the recording medium conveyed by the conveying belt;

an application unit which applies a pretreatment liquid to the first face of the recording medium before the second face of the recording medium comes into contact with the surface of the conveying belt to which the charges have been imparted by the first DC charge unit; and a second DC charge unit, provided between the first DC charge unit and the recording head, which imparts a polarity reverse to the charges imparted by the first DC charge unit to the first face of the recording medium to which the pretreatment liquid has been applied.

2. The ink jet recording apparatus according to claim 1, wherein the conveying belt includes a resistance layer, and the volume resistance ratio of the resistance layer is equal to or greater than $1.0\times10^{12}$ (Ω·cm).

3. The ink jet recording apparatus according to claim 1, wherein the conveying belt consists of two layers including a resistance layer and a middle-resistance layer of which the volume resistance ratio is lower than the resistance layer.

4. The ink jet recording apparatus according to claim 3, wherein the volume resistance ratio of the middle-resistance layer is equal to or greater than $1.0\times10^{4}$ (Ω·cm) and equal to or less than $1.0\times10^{9}$ (Ω·cm).

5. The ink jet recording apparatus according to claim 1, further comprising a first grounding portion which grounds a face opposite to the surface of the conveying belt.

6. The ink jet recording apparatus according to claim 1, further comprising a grounding portion which grounds the first face of the recording medium.

7. The ink jet recording apparatus according to claim 1, wherein after application processing, the recording medium has a resistance ratio equal to or less than $5.0\times10^{12}$ (Ω/□) on the first face to which the pretreatment liquid has been applied.

8. The ink jet recording apparatus according to claim 1, wherein the pretreatment liquid is applied to both of the first face and the second face of the recording medium in application processing.

9. The ink jet recording apparatus according to claim 8, wherein the average value of the resistance ratio of the first face and the resistance ratio of the second face in the recording medium after the application processing is equal to or less than $1.0\times10^{13}$ (Ω/□).

10. The ink jet recording apparatus according to claim 8, wherein double-sided printing is performed after application processing.

11. The ink jet recording apparatus according to claim 1, wherein the resistance ratio in the thickness direction of the recording medium after application processing is equal to or greater than $5.0\times10^{9}$ (Ω·cm).

12. The ink jet recording apparatus according to claim 1, wherein the pretreatment liquid includes a surfactant.

13. An ink jet recording apparatus which records on a recording medium having a first face and a second face, the apparatus comprising:

a conveying belt configured to convey the recording medium while a surface of the conveying belt contacts the second face;

a driving roller for supporting and driving the conveying belt, wherein the driving roller is electrically grounded;

a first DC charge unit which imparts one of positive charges and negative charges to the surface of the conveying belt;

a recording head which discharges ink to the first face of the recording medium conveyed by the conveying belt;

an application unit which applies a pretreatment liquid to the first face of the recording medium before the second face of the recording medium comes into contact with the surface of the conveying belt to which the charges have been imparted by the first DC charge unit; and a second DC charge unit, provided between the first DC charge unit and the recording head, which imparts a polarity reverse to the charges imparted by the first DC charge unit to the first face of the recording medium to which the pretreatment liquid has been applied.

14. The ink jet recording apparatus according claim 13, further comprising a pinch roller disposed upstream of the recording head for pinching the recording medium in cooperation with the conveying belt, wherein the pinch roller serves as the second DC charge unit.

15. The ink jet recording apparatus according claim 14, wherein the pinch roller is grounded.

16. The ink jet recording apparatus according claim 15, wherein the pinch roller pinches the recording medium and the conveying belt in cooperation with the driving roller.

17. The ink jet recording apparatus according to claim 13, wherein the pretreatment liquid includes a surfactant.

18. A recording apparatus which records on a recording medium having a first face and a second face, the apparatus comprising:

a conveying belt configured to convey the recording medium while a surface of the conveying belt contacts the second face;

a driving roller configured to support and to drive the conveying belt;

a first DC charge unit configured to impart one of positive charges and negative charges to the surface of the conveying belt;

a recording head configured to record an image on the first face of the recording medium conveyed by the conveying belt;

an application unit configured to apply a pretreatment liquid to the first face of the recording medium before the second face of the recording medium comes into contact with the surface of the conveying belt to which the charges have been imparted; and a second DC charge unit, provided between the first DC charge unit and the recording head, configured to impart a polarity reverse to the charges imparted by the first DC charge unit to the first face of the recording medium to which the pretreatment liquid has been applied.

19. The recording apparatus according to claim 18, further comprising a pinch roller disposed upstream of the recording head for pinching the recording medium in cooperation with the conveying belt, wherein the pinch roller serves as the second DC charge unit.

20. The recording apparatus according to claim 19, wherein the pinch roller is grounded.

21. The recording apparatus according to claim 19, wherein the pinch roller pinches the recording medium and the conveying belt in cooperation with the driving roller.

22. The recording apparatus according to claim 18, wherein the pretreatment liquid includes a surfactant.

* * * * *